US005077985A

United States Patent [19]

Buchser et al.

[11] Patent Number: 5,077,985

[45] Date of Patent: Jan. 7, 1992

[54] ICE CHUTE FOR DEEP DOOR REFRIGERATOR

[75] Inventors: William J. Buchser, Marrs Township, Posey County; Andrew T. Tershak, Center Township, Vanderburgh County, both of Ind.

[73] Assignee: Whirlpool Corporation, Benton Harbor, Mich.

[21] Appl. No.: 586,532

[22] Filed: Sep. 21, 1990

[51] Int. Cl.[5] ..... F25C 5/18

[52] U.S. Cl. ..... 62/344; 222/146.6

[58] Field of Search ..... 62/344; 222/146.1, 146.6

[56] References Cited

U.S. PATENT DOCUMENTS

| | | | |
|---|---|---|---|
| 3,537,132 | 11/1970 | Alvarez | 62/266 |
| 3,537,273 | 11/1970 | Alvarez | 62/266 |
| 4,084,725 | 4/1978 | Buchser | 221/75 |
| 4,090,641 | 5/1978 | Lindenschmidt | 222/70 |
| 4,102,660 | 7/1978 | Beckett et al. | 62/344 |
| 4,209,999 | 7/1980 | Falk et al. | 62/344 |
| 4,285,212 | 8/1981 | Prada | 62/344 |
| 4,333,588 | 6/1982 | Schreck et al. | 222/164 |

*Primary Examiner*—William E. Tapolcai
*Attorney, Agent, or Firm*—Wood, Phillips, Mason, Recktenwald & Vansanten

[57] ABSTRACT

An ice making apparatus for a deep door refrigerator comprises an ice container assembly having a container for storing ice cubes and a convying apparatus for conveying ice cubes from the container to a downwardly facing discharge opening. A door mounted to the refrigerator cabinet includes an exterior panel and an interior panel. The interior panel includes a generally vertical wall connected to a horizontal wall portion and an opening through a connected portion of the vertical wall and horizontal wall portion, the opening being disposed below the discharge opening when the door is in a closed position. A dispenser housing assembly is mounted to an opening in the door exterior panel and includes an actuator actuable to request delivery of ice bodies and a dispenser opening for delivering ice. An ice chute is mounted to the interior panel and extends between the interior panel opening and the dispenser opening for transferring ice conveyed from the discharge opening to the dispenser opening.

12 Claims, 1 Drawing Sheet

ICE CHUTE FOR DEEP DOOR REFRIGERATOR

FIELD OF THE INVENTION

This invention relates to a through-the-door ice making apparatus and, more particularly, to an ice chute for a deep door refrigeration apparatus.

BACKGROUND OF THE INVENTION

A typical household refrigeration apparatus comprises a refrigerator compartment and a freezer compartment. The freezer compartment often includes an automatic ice making apparatus. For convenience, such refrigeration apparatus may include a through-the-door ice dispensing apparatus which can provide for the dispensing of both whole, or cubed, ice or crushed ice. The term "cubed ice" can refer to crescent-shaped ice bodies as well as any other shape that has not been crushed or otherwise broken up into small or irregular shaped pieces.

A typical through-the-door ice dispensing apparatus includes an ice container assembly in the freezer compartment having a container for storing ice cubes and means for conveying ice cubes from the container to a downwardly facing discharge opening. A chute is typically provided to provide a passageway through the door and opens into a dispenser opening for delivering ice when an ice lever is actuated to request delivery of ice cubes or crushed ice. In known prior art refrigeration apparatus, the ice chute generally terminates inside of the freezer compartment at an opening in a horizontal plane comprising a portion of an interior door panel.

Problems can arise when the design of the refrigeration apparatus has been modified to accommodate different requirements. For example, some refrigeration apparatus are provided with deeper doors which ca be utilized to provide additional storage capacity without substantially changing the cabinet arrangement. At the same time, the vertical location of a dispenser housing on the exterior of the door is typically desired at a particular height from the floor to better accommodate users as well as to present a uniform desirable appearance on a sales room floor when several different models are aligned side-by-side.

Also, it is necessary that the opening of the ice chute be high enough and wide enough so that neither cubes nor crushed ice will hang up or jam the chute as by accumulation of particles, while providing adequate slope along the bottom of the chute to compel falling ice to continue its movement as desired through the dispenser opening.

The present invention is intended to solve one or more of the problems discussed above in a novel manner.

SUMMARY OF THE INVENTION

In accordance with the invention, an ice dispensing apparatus includes an ice passage through the door having its upper opening extending along intersecting horizontal and vertical planes of the interior door panel.

Broadly, there is disclosed herein an ice making apparatus comprising an ice container assembly in a refrigerated space having a container for storing ice bodies and means for conveying ice bodies from the container to a downwardly facing discharge opening. A door is mounted to a refrigeration apparatus cabinet for selective access to the space and includes an exterior panel and an interior panel. The interior panel includes a generally vertical wall connected to a horizontal wall portion and an opening through a connected portion of the vertical wall and horizontal wall portion, the opening being disposed below the discharge opening when the door is in a closed position. A dispenser housing assembly is mounted to an opening in the door exterior panel and includes a actuator actuable to request delivery of ice bodies and a dispenser opening for delivering ice bodies. An ice chute is mounted to the interior panel and extends between the interior panel opening and the dispenser opening for transferring ice bodies conveyed from the discharge opening to the dispenser opening.

It is a feature of the invention that the interior panel is turned downwardly at the opening to define a continuous perimeter wall.

It is another feature of the invention that the ice chute is of a shape corresponding to the perimeter wall and is telescopically received on the perimeter wall.

It is a further feature of the invention that the perimeter wall is telescopically received within the ice chute.

It is yet another feature of the invention that the ice chute is formed of injection molded plastic.

Further features and advantages of the invention will readily be apparent from the specification and from the drawings.

DESCRIPTION OF THE INVENTION.

Figure 1:
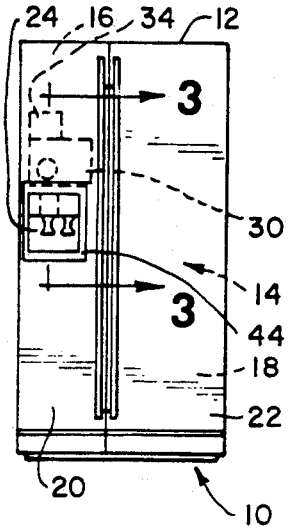
FIG. 1 is a front elevation view showing a refrigeration apparatus including an ice dispensing apparatus according to the invention.

With reference to FIG. 1, a refrigeration apparatus 10, comprising a side-by-side refrigerator/freezer, includes a cabinet 12 having a storage space 14. Particularly, the storage space 14 comprises a below-freezing, or freezer, compartment 16, and an above-freezing, or fresh food, refrigerator compartment 18. Access to the compartments 16 and 18 is had through respective freezer and refrigerator doors 20 and 22 hingedly mounted to the cabinet 12, as is well known.

The freezer door 20 is provided with a through-the-door ice dispensing apparatus 24. The dispensing apparatus 24 is partially contained within a housing 26, see FIG. 3, suitably mounted in the freezer door 20.

Figure 3:
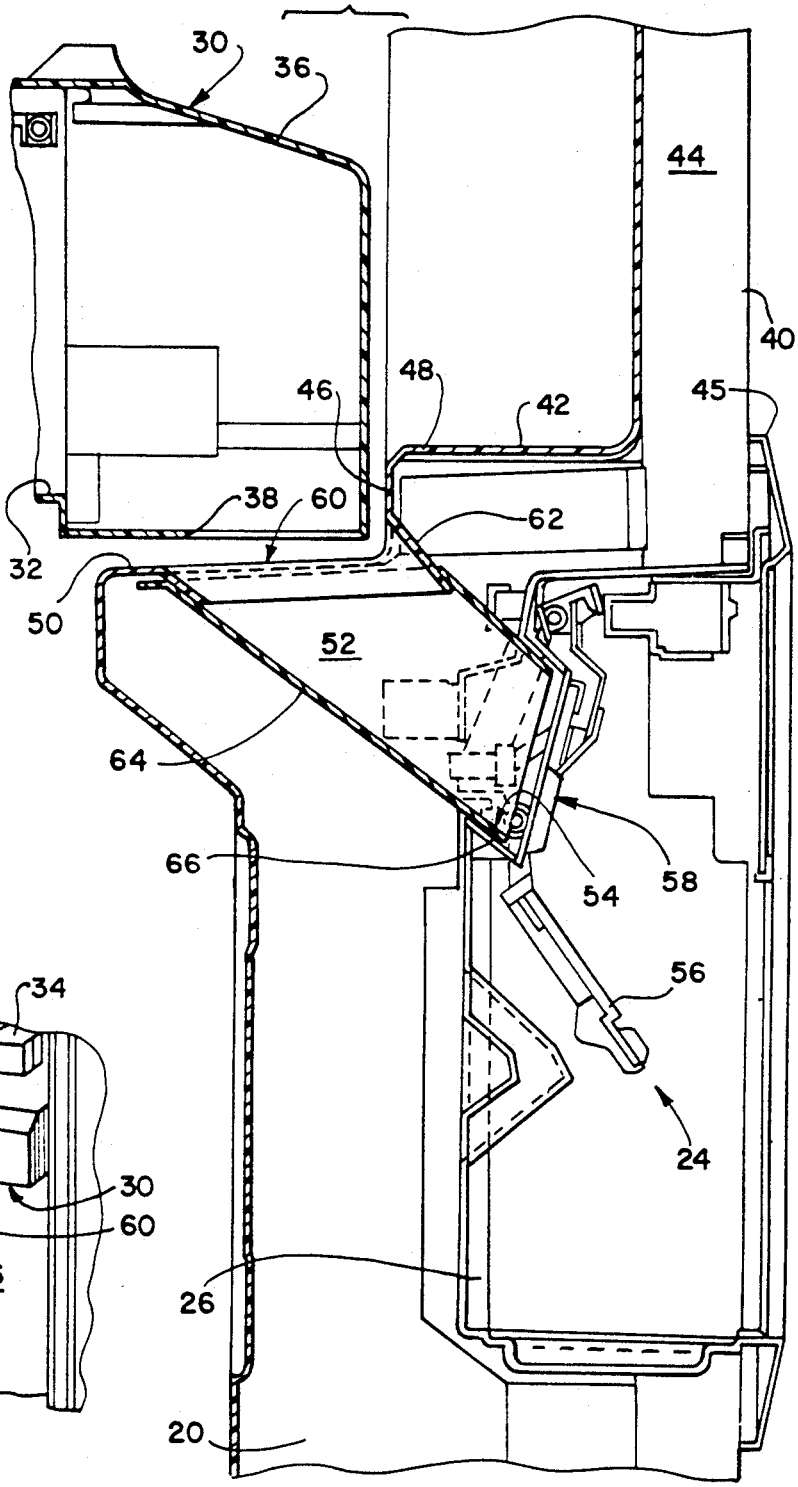
FIG. 3 is a partial sectional view taken along the line 3—3 of FIG. 1.
Figure 2:
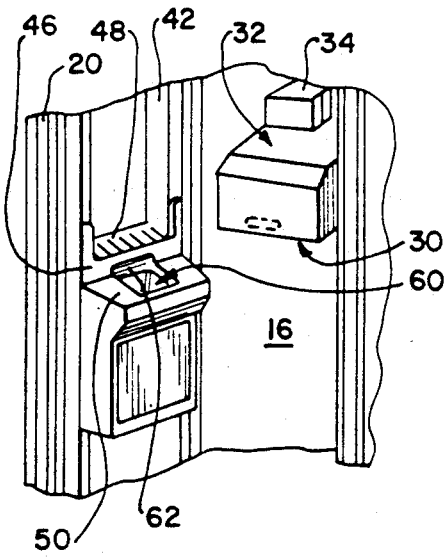
FIG. 2 is a partial perspective view of the refrigeration apparatus of FIG. 1 with a freezer door in an open position.

With reference also to FIGS. 2 and 3, the ice dispensing apparatus 24 utilizes an ice container assembly 30 in the freezer compartment 16 having a container 32 for storing ice cubes which are delivered thereto from a superjacent ice making apparatus 34 of conventional construction. The ice container assembly 30 also includes a conveyor structure of any known form, such as shown in copending application Ser. No. 459,651, filed Jan. 2, 1990, the specification of which is hereby incorporated by reference herein, in a housing 36 forwardly of the container 32 for conveying ice cubes from the container 32 to a downwardly facing discharge opening 38. As discussed in the copending application, either crushed ice or cubed ice can be delivered to the discharge opening 38.

The ice dispensing apparatus 24 further includes novel structure mounted within the freezer door 20 for delivering dispensed ice from the discharge opening 38 to a dispensing space, as discussed more specifically below.

The freezer door 20 includes an exterior panel 40 and an interior panel 42 with suitable insulation provided in a space 44 therebetween. The dispenser housing assembly 26 is mounted at a select vertical height of the exterior panel 40 as represented by position of a bezel 45. The interior panel 42 is formed of molded plastic and is molded to provide suitable shelf structure and the like for storing goods to be refrigerated. For example, the interior panel 42 includes a generally vertical wall 46 connecting a first horizontal wall portion 48 to define a shelf, and a second horizontal wall portion 50 used in connection with the ice dispensing apparatus 24. Particularly, and with reference to FIG. 3, the horizontal wall portion 50 is positioned immediately below the ice container assembly conveying structure housing 36 when the door 20 is in the closed position. The interior panel 42 includes an opening 60 in communication with a through-the door ice passage 52 to provide delivery of ice from the discharge opening 38 to an exterior dispensing opening 54 for delivery of ice to a container selected by a user for such purpose. Particularly, any such container may be placed against an actuator lever 56 in the dispenser housing 26 to pivot the same to open a closure 58 disposed over the dispensing opening 54 to cause ice cubes or crushed ice to be dropped into the container. Suitable switching devices may also be provided for actuating the conveyor structure, as required.

In a refrigeration apparatus including a deeper-than-normal door to accommodate deeper shelves 48, problems can arise due to the limited usable depth of the horizontal wall portion 50 to provide an opening for ice delivery. Although the passage 52 can be moved so that its entry opening 60 is further inwardly, the same would provide less slope than what otherwise might be desired. As is apparent, it is desirable to provide sufficient slope to facilitate passage of ice through the passage 52 and to prevent jam-ups. Also, it is desirable that the passage 52 be configured so that other structures such as the housing 26 and the ice container assembly 30 need not be repositioned from one model refrigeration apparatus to another.

In accordance with the invention, the opening 60 through the interior panel 42 intersects a plane in the vertical wall 46 and the horizontal wall portion 50. More specifically, the opening 60 is provided through a connected portion of the vertical wall 46 and the horizontal wall portion 50. The interior panel 42 includes integral wall portions turned downwardly and outwardly at the opening 60 to provide a squareshaped continuous perimeter wall 62 around all four sides of the opening 60.

An ice chute 64, of molded plastic construction, is of a shape corresponding to the perimeter wall 62 and defines the wall surfaces for the passage 52. The inner diameter of the chute 64 is approximately equal to the outer diameter of the perimeter wall 62 and is telescopically received thereon. The perimeter wall 62 being disposed within the ice chute 64 prevents the build-up of ice pieces as there are no obstructions for the same to collect on. An outer end 66 of the ice chute 64 is mated in a conventional manner rearwardly of the closure 58.

In accordance with the invention, the ice dispensing apparatus 24 provides a wide enough opening 60 below the discharge opening 38 and entering into the chute 64 so that neither ice cubes nor crushed ice will be likely to hang up or jam the ice chute 64 as by accumulation of particles, while providing adequate slope, i.e. a steep enough incline, along the entire length of the chute 64 to also compel the falling ice to continue its movement as desired through the dispensing opening 54. Furthermore, the illustrated embodiment allows tooling for the ice chute, assuming it to be injection molded plastic, to be simpler to accomplish, and the installation of the ice chute 64 into the final assembly is made easier by providing a straight line installation owing to the telescopic construction.

The illustrated embodiment of the invention illustrates the broad inventive concepts comprehended hereby.

We claim:

1. In a refrigeration apparatus including a cabinet housing a refrigerated space and ice making apparatus in said space, an ice dispensing apparatus comprising:

an ice container assembly in said space having a container for storing ice bodies and means for conveying ice bodies from said container to a downwardly facing discharge opening;

a door mounted to said cabinet for selective access to said space and including an exterior panel and an interior panel, said interior panel including a generally vertical wall connected to a horizontal wall portion and an opening through said interior panel, a portion of said opening being through said vertical wall and another portion of said opening being through said horizontal wall portion, said opening being disposed below said discharge opening when said door is in a closed position;

a dispenser housing assembly mounted to an opening in said door exterior panel and including an actuator actuable to request delivery of ice bodies and a dispenser opening for delivering ice bodies; and an ice chute mounted to said interior panel and extending between said interior panel opening and said dispenser opening for transferring ice bodies conveyed from said discharge opening to said dispenser opening.

2. The ice dispensing apparatus of claim 1 wherein said interior panel is turned downwardly at said opening to define a continuous perimeter wall.

3. The ice dispensing apparatus of claim 2 wherein said continuous perimeter wall is square-shaped.

4. The ice dispensing apparatus of claim 3 wherein said ice chute is of a shape corresponding to said perimeter wall and is telescopically received on said perimeter wall.

5. The ice dispensing apparatus of claim 4 wherein said perimeter wall is telescopically received within said ice chute.

6. The ice dispensing apparatus of claim 1 wherein said ice chute is formed of injection molded plastic.

7. In a refrigeration apparatus including a cabinet housing a refrigerated space, an ice container assembly at a select vertical position in said space having a container of restoring ice cubes and means for conveying ice cubes from said container to a downwardly facing discharge opening, a door mounted to said cabinet for selective access to said space, and a dispenser housing assembly mounted to said door at a select vertical position and including an actuator actuable to request delivery of ice and a dispenser opening for delivering ice, an ice dispensing apparatus comprising:

said door including an interior panel including a generally vertical wall connected to a horizontal wall portion and an opening through said interior panel, a portion of said opening being through said vertical wall and another portion of said opening being through said horizontal wall portion, said opening being disposed below said discharge opening when said door is in a closed position;

an ice chute mounted to said interior panel and extending between said interior panel opening and said dispenser opening for transferring ice bodies conveyed from said discharge opening to said dispenser opening.

8. The ice dispensing apparatus of claim 7 wherein said interior panel is turned downwardly at said opening to define a continuous perimeter wall.

9. The ice dispensing apparatus of claim 8 wherein said continuous perimeter wall is square-shaped.

10. The ice dispensing apparatus of claim 9 wherein said ice chute is of a shape corresponding to said perimeter wall and is telescopically received on said perimeter wall.

11. The ice dispensing apparatus of claim 10 wherein said perimeter wall is telescopically received within said ice chute.

12. The ice dispensing apparatus of claim 7 wherein said ice chute is formed of injection molded plastic.

* * * * *